United States Patent [19]

Ariel et al.

[11] Patent Number: 4,967,172

[45] Date of Patent: Oct. 30, 1990

[54] MICROWAVE PHASE SHIFTER CIRCUIT

[75] Inventors: Joëlle Ariel, Paris; Jacques Legendre, Longjumeau, both of France

[73] Assignee: Thomson-CSF, Puteaux, France

[21] Appl. No.: 329,806

[22] Filed: Mar. 28, 1989

[30] Foreign Application Priority Data

Apr. 1, 1988 [FR] France ..... 88 04388

[51] Int. Cl.[5] ..... H01P 1/18

[52] U.S. Cl. ..... 333/161; 333/140; 333/164

[58] Field of Search ..... 333/161, 164, 140, 246, 333/109, 117, 156, 101, 103, 104

[56] References Cited

U.S. PATENT DOCUMENTS

| | | | |
|---|---|---|---|
| 4,056,792 | 11/1977 | Horwitz et al. | 333/156 |
| 4,195,271 | 5/1980 | Schiek et al. | 333/161 |
| 4,301,432 | 11/1981 | Carlson et al. | 333/109 |

FOREIGN PATENT DOCUMENTS

| | | |
|---|---|---|
| 1207852 | 7/1986 | Canada . |
| 0013222 | 7/1980 | European Pat. Off. . |
| 1570001 | 6/1969 | France . |
| 2210021 | 7/1974 | France . |
| 1178488 | 3/1967 | United Kingdom . |

OTHER PUBLICATIONS

IEEE Transactions on Microwave Theory and Techniques, vol. 24, No. 4, Apr. 1976, pp. 231–233, New York, U.S.; B. Schiek, et al.: "An improved microstrip-to-microslot transition."

IEEE Transactions on Microwave Theory and Techniques, vol. MTT-22, No. 6, Jun. 1974, pp. 675–688; R. W. Burns et al.: "Low cost design techniques for semiconductor phase shifters."

*Primary Examiner*—Eugene R. LaRoche
*Assistant Examiner*—Seung Ham
*Attorney, Agent, or Firm*—Oblon, Spivak, McClelland, Maier & Neustadt

[57] ABSTRACT

Disclosed are microwave phase shifter circuits which achieve phase shifts of elementary values and of whole number multiples of the values. The phase shifter circuit is made by utilizing of strip lines arranged in candlestick form on one face of a substrate and a slot line arranged on the other face. The length of the branches of the candlestick differ by b/4, b being the wavelength, and the ends of the branches are short-circuited or not short-circuited by utilizing of diodes which can be forward biased or reverse biased.

6 Claims, 4 Drawing Sheets

MICROWAVE PHASE SHIFTER CIRCUIT

BACKGROUND OF THE INVENTION

1. Field of the Invention

The invention concerns microwave phase shifter circuits and, more particularly, microwave phase shifter circuits that achieve elementary phase shifts under the control of electrical signals and can be grouped together to obtain phase shifts that are whole number multiples of elementary phase shifts. In microwave applications, transmission lines that may take different forms are used. FIGS. 1 to 4 respectively show views that represent a slot transmission line and a strip transmission line, in this particular case a microstrip transmission line.

A slot line (FIGS. 1 and 2) is formed by an aperture 1 made in a metallic layer 2, deposited on a dielectrical substrate 3. The dielectrical substrate ensures the mechanical strength of the metallic conductors and forms the transmission medium of the microwave, the energy of which is concentrated between the edges 4 and 5 of the slot. In FIG. 2, the lines of force of the electrical field E have been shown in dashes, and those of the magnetic field in solid lines. The thickness of the dielectric material is related to its nature, and the width of the slot line determines the characteristic impedance of the line.

The strip transmission line (FIGS. 3 and 4) has a dielectric plate 7 placed between a strip 6 and a metallic plane 8, also called a ground plane. As for the slot line shown in FIGS. 1 and 2, almost all the energy is concentrated in the dielectric 7. In FIG. 4, the lines of force of the electrical field E are shown in dashes. The dielectric materials used in the two slot or strip lines may be polytetrafluorethylene, a beryllium oxide, an aluminium ceramic, a quartz or a ferrite.

In addition to having a function of transmission, the slot or strip lines may separately perform a phase-shifting function, in being configured in different ways. Thus, in implementing a strip line type of technology, it is possible to make so-called switched-line phase shifters, disturbance phase shifters or 3 dB/90° coupler phase shifters.

For a description of these prior art phase shifters, whether of the slot line type or the strip line type, reference could be made to several articles in the Journal IEEE TRANSACTIONS ON MICROWAVE THEORY AND TECHNIQUES and, especially, to an article by Elio A. MARIANI et al., "Slot Line Characteristics", Vol. MTT-17, No. 12, December 1969, pp. 1091 to 1096, as well as an article by J. F. WHITE, "High Power p-i-n Diode Controlled Microwave Transmission Phase Shifters", March 1965, pp. 232 to 242.

In certain applications, it is necessary to change from one type of line to another and, to this effect, numerous coupling devices have been proposed. These coupling devices are generally not designed to achieve, at the same time, a phase shifter circuit for which the phase shift value would be controlled. When a determined phase shift has to be introduced, the assembly is modified to insert a phase shifter circuit of any known type before or after the coupling device, thus increasing losses, complicating the assembly and making it bulkier. There are, therefore, applications where coupling devices need to have incorporated phase shifters or, conversely, applications where phase shifters need to be associated with coupling devices.

SUMMARY OF THE INVENTION

An object of the present invention, therefore, is to achieve, in one and the same structure, a change of transmission line and controlled phase shift of the incident wave, thus causing a reduction in losses and bulk.

The invention relates to a microwave phase shifter circuit comprising:

a substrate made of dielectric material, with one of its faces comprising a slot line while the other comprises a fork-shaped strip line with two parallel branches connected by a transversal branch, perpendicular to the direction, of the slot line, the length of the branches of the strip line differing by b/4 if b is the wavelength of the microwave signal;

two PIN diodes, each connected between the end of one branch and the potential of the ground;

means to turn the PIN diodes simultaneously on or off so as to introduce an identical variation in impedance in each branch, and thus to obtain a determined phase variation between the input wave applied to one line and the output wave appearing on the other line, when the state of said diodes is changed.

BRIEF DESCRIPTION OF THE DRAWINGS

Other features and advantages of the present invention will emerge from the following description of a special embodiment, said description being made with reference to the appended figures wherein.

DESCRIPTION OF PREFERRED EMBODIMENTS

FIGS. 1 to 4 have been described briefly in the introduction in order to define the field of the invention, namely that of slot lines and strip lines.

Figure 1:
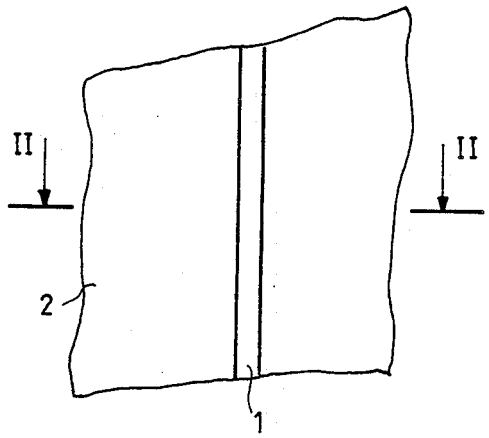
FIG 1 PRIOR ART
FIG. 1 shows atop view of a slot line.
Figure 2:
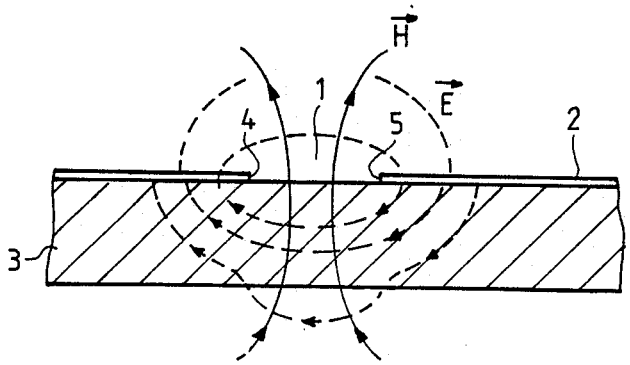
FIG 2 PRIOR ART
FIG. 2 shows a sectional view of the slot line along the line II—II of FIG. 1.
Figure 3:
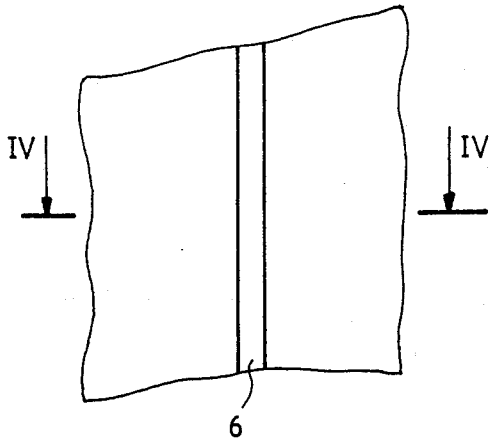
FIG 3 PRIOR ART
FIG. 3 shows a top view of a strip or microstrip line.
Figure 4:
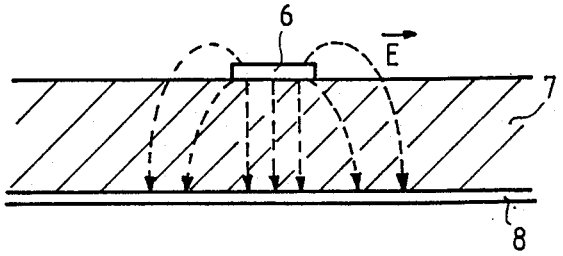
FIG 4 PRIOR ART
FIG. 4 shows a sectional view of the strip line along the line IV—IV of FIG. 3.
Figure 5:
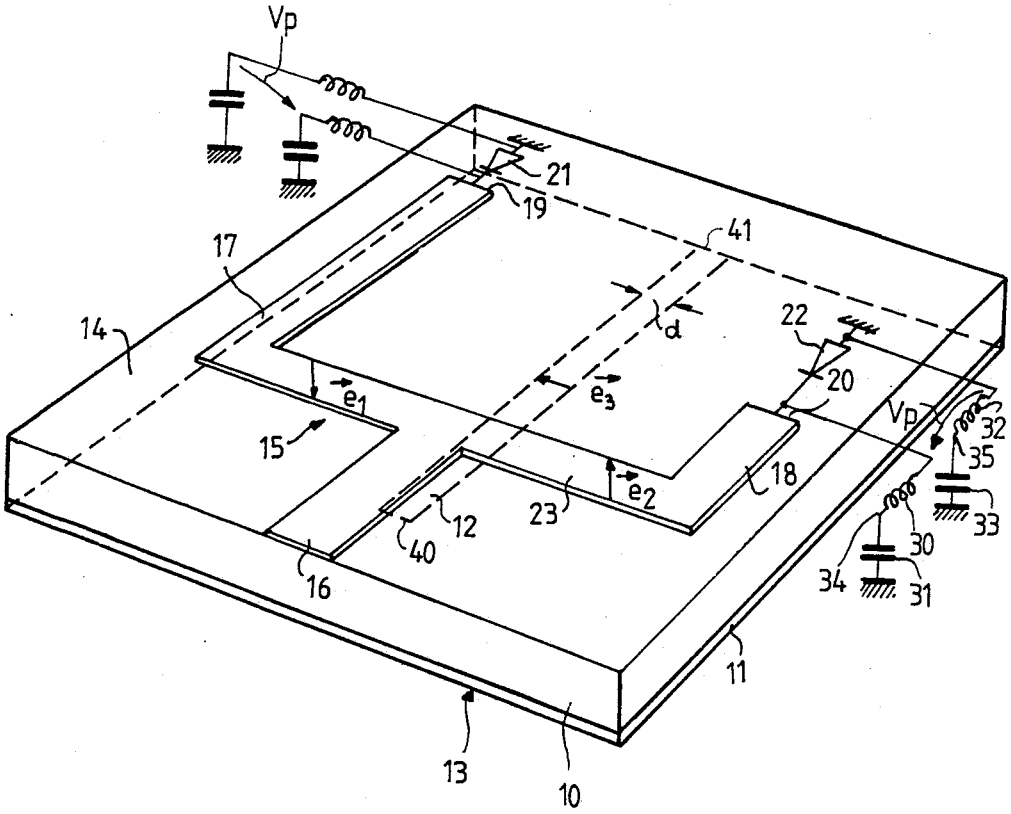
FIG. 5 shows a cavalier projection of a microwave phase shifter circuit according to the invention, and, FIGS. 6, 7 and 8 are diagrams that provide for an understanding of the working of the microwave phase shifter circuit according to the invention.

FIG. 5 is a perspective view giving a schematic view of a microwave phase shifter circuit that has a substrate 10, made of dielectric material similar to the one carrying the reference 3 or 7 in FIGS. 2 and 4. The lower face of the substrate 10 is coated with a metallic layer 11 in which there is a rectilinear slot 12 of a certain width d. This slot 12 is made, for example, by chemical action, so as to achieve a slot line of the type described with reference to FIGS. 1 and 2. This slot 12 does not extend throughout the length of the substrate and stops at one end 40 by a short-circuit formed by the metallic layer 11. The other end 41 of the slot line is open.

The upper face 14 of the substrate 10 has a strip 15 called a microstrip, with a particular shape. It has a central branch 16, and two side branches 17 and 18 which are connected to the central branch 16 by a transversal branch 23, all the branches forming a structure shaped like a fork with two branches of unequal length. The branch 17, for example, has a length which is greater by b/4 than that of the branch 18 for reasons which shall be explained hereinafter, b being the wavelength of the microwave signals transmitted by the line.

The ends 19 and 20 of the branches 17 and 18 are each connected to the cathode of a PIN diode 21 and 22, the anode of which is connected to the ground. These diodes 21 and 22 have been shown in their electrical form, but it will be understood that, in practice, they take the form of a component which is wired to the substrate 10 by connecting one of the output terminals to the end of a branch 17 or 18 and the other output terminal to the potential of the ground.

These diodes 21 and 22 are biased by standard type bias circuits. For example, the bias circuit for the diode 22 comprises a choke coil 30 and a bypass capacitor 31 for the cathode of the diode, and a choke coil 32 and a bypass capacitor 33 for the anode of the diode. The bias voltage Vp is applied between the points 34 and 35 of the bias circuits.

FIG. 5 shows the diodes 21 and 22 connected in a certain direction between the end of the branch and the potential of the ground. Of course, they may be connected in the other direction. The important point is that they should be capable of being on or off depending on the bias voltage Vp which is applied to them.

The positions of the slot line 12 and the strip line should be such that the slot line is aligned with the central branch 16, and such that its end 40 reaches beneath the branch 16 so as to obtain the most efficient coupling possible. Moreover, the transversal branch 23 has equal length on either side of the central branch 16.

Figure 6:
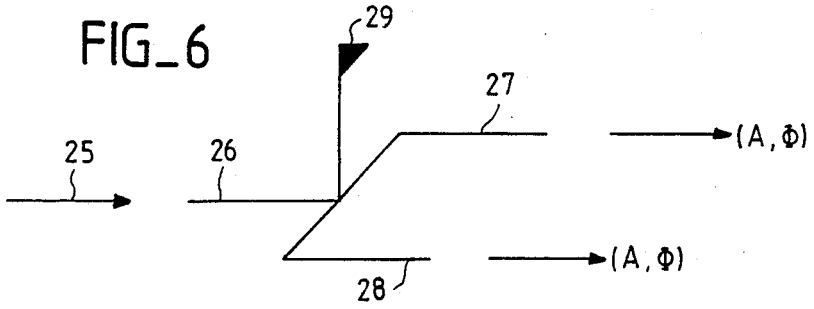
Figure 7:
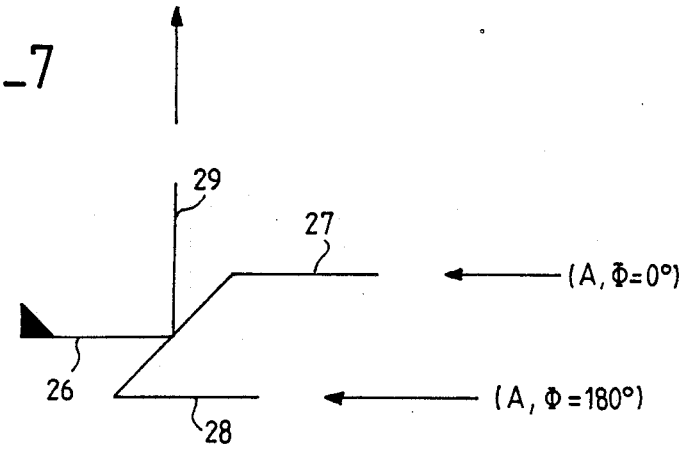
Figure 8:
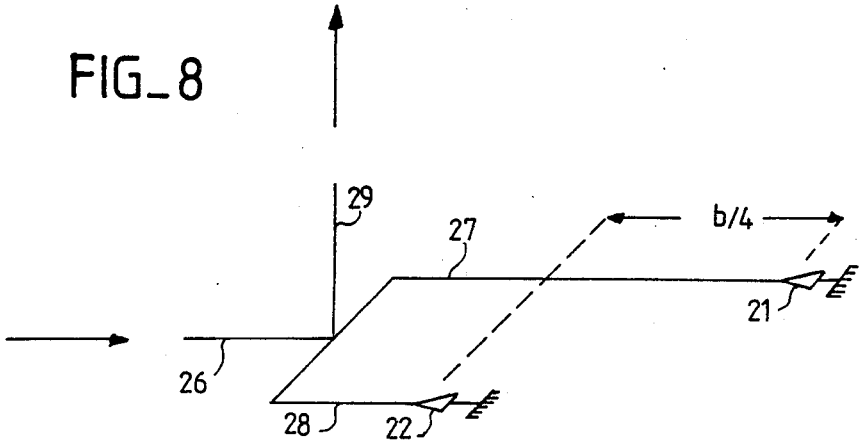

The working of the microwave phase shifter circuit, which has just been described with reference to FIG. 5, shall now be explained with reference to FIGS. 6, 7 and 8. The branches 16, 17, and 18 form a power divider for the incident wave transmitted by the line 16, like a magic T junction. It is known that, in a magic T junction (FIG. 6), the incident wave 25 at the input 26 is divided into two waves with equal amplitudes A and equal phases Φ on the channels 27 and 28, the channel 29 being uncoupled. It is also known (FIG. 7) that two waves, having the same amplitude A but being in phase opposition, which are applied to the channels 27 and 28 get combined in phase at the channel 29, the channel 26 being uncoupled.

In the case of the phase shifter circuit of FIG. 5, following the branch 17, the length of which greater by b/4 than the length of the branch 18 (FIG. 8), the incident wave at 16, after being divided in the two lateral branches, is reflected by the ends 19 and 20 of said branches, but the waves reflected have a phase difference of 180° due to a difference in path lengths equal to b/2. The result thereof is that they can leave not by the input 16 but by the slot line 12, the coupling with the latter being achieved by means of the transversal branch 23.

By way of an illustration, FIG. 5 shows the direction of the magnetic fields e1 and e2 in the substrate 10 beneath the transversal branch 23, and the electrical field e3 resulting from their combination in the slot line 12. The working of the phase shifter circuit has been described for a certain direction of transmission (strip line towards slot line) but it is clear that the phase shifter circuit also works in the other direction of transmission (slot line towards strip line).

The variation in the phase shift between the wave entering by the strip line 16 and the wave leaving by the slot line 12 depends on the variation in impedance shown by the diodes 21 and 22, depending on whether they are simultaneously on or off, their state depending on the bias voltage Vp that is applied to them.

It must be noted that there is a certain phase shift between the input waves and the output waves for a certain state of the diodes, and that this phase shift is modified when the diodes go into the other state, so that the result thereof is a variation in phase shift between the two successive states of the diodes.

More precisely, the variation in the phase shift to be obtained is computed as a function of the line impedance, the length of the line and the capacitance of the diode, the computation being done in accordance with the prior art, such as that mentioned in the introduction. It is thus possible to make phase shifter circuits which introduce elementary phase shifts of 22.5°, 45° or 90° in frequency bands of 10%.

Furthermore, these elementary phase shifter circuits can be assembled to achieve different combinations of elementary phase shifts. Each elementary phase shift is obtained by making the diodes 21 and 22 simultaneously on or off.

The phase shifter circuits of a group can be assembled in various ways, one of which consists in using one and the same substrate on which the different slot line/strip line transitions are made. The coupling between the adjacent phase shifter circuits can be done in various ways, for example by a slot line/slot line coupling or by a strip line/strip line coupling or, again, by a slot line/-strip line coupling and vice versa.

What is claimed is:

1. A microwave phase shifter circuit comprising:

a substrate made of dielectric material having two faces;

a slot line placed on one of said faces;

a strip line placed on the other of said faces, said strip line having the shape of a fork with two parallel branches connected by a transversal branch, perpendicular to the direction of said slot line, the lengths of said branches of the strip line differing by b/4 where b is the wavelength of the microwave signal;

two PIN diodes, each connected between the end of one of said branches and the ground; and means to turn said PIN diodes simultaneously on or off so as to introduce an identical impedance variation in each of said branches, and thus to obtain a determined phase variation between an input wave, applied to one line of said slot line and said strip line, and the corresponding output wave appearing on the other line of said slot line and said strip line, when the state of said diodes is changed.

2. A phase shifter circuit comprising several phase shifter circuits according to claim 1, placed in series, each phase shifter circuit being designed to introduce a determined phase variation during the change in state of said diodes.

3. A phase shifter circuit according to claim 2, wherein said phase shifter circuits are made on one and the same substrate.

4. A phase shifter circuit according to claim 3, wherein two adjacent phase shifter circuits are coupled by means of their slot line.

5. A phase shifter circuit according to claim 3, wherein two adjacent phase shifter circuits are coupled by means of their strip line.

6. A phase shifter circuit according to claim 3, wherein two adjacent phase shifter circuits are coupled by a slot line/strip line transition or vice versa.

* * * * *